US007967289B2

(12) United States Patent
Tharayil et al.

(10) Patent No.: US 7,967,289 B2
(45) Date of Patent: Jun. 28, 2011

(54) DRIVE ROLL/IDLER ROLL NIP RELEASE MECHANISM

(75) Inventors: Marina L Tharayil, Rochester, NY (US); Keith A Buddendeck, Rochester, NY (US); Paul J Degruchy, Hilton, NY (US); Steven R Moore, Pittsford, NY (US); Barry P Mandel, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 55 days.

(21) Appl. No.: 12/547,894

(22) Filed: Aug. 26, 2009

(65) Prior Publication Data

US 2011/0049787 A1 Mar. 3, 2011

(51) Int. Cl.
*B65H 5/06* (2006.01)

(52) U.S. Cl. ..... 271/274; 271/273

(58) Field of Classification Search ..... 271/272, 271/273, 274, 10.13, 266, 10.04, 10.11
See application file for complete search history.

(56) References Cited

U.S. PATENT DOCUMENTS

| | | | | |
|---|---|---|---|---|
| 4,721,297 | A * | 1/1988 | Katayama | 271/10.04 |
| 6,641,130 | B2 * | 11/2003 | Lee et al. | 271/10.04 |
| 6,817,611 | B2 * | 11/2004 | DiRamio | 271/273 |
| 7,384,043 | B2 * | 6/2008 | Giese | 271/273 |
| 7,448,623 | B2 * | 11/2008 | Ahn et al. | 271/273 |
| 7,506,870 | B2 | 3/2009 | Park | |
| 7,748,695 | B2 * | 7/2010 | Miura et al. | 271/10.13 |
| 7,828,290 | B2 * | 11/2010 | Muratani | 271/256 |
| 2007/0029725 | A1 * | 2/2007 | Marx et al. | 271/272 |
| 2008/0265486 | A1 * | 10/2008 | Schalk et al. | 271/10.13 |

FOREIGN PATENT DOCUMENTS

JP 60077046 A * 5/1985

* cited by examiner

*Primary Examiner* — Kaitlin S Joerger

(57) ABSTRACT

A drive roll/idler roll nip release mechanism utilizes the motor used for the drive nip, coupled with one-way clutches, to power the nip release as a sheet is handed off to a downstream nip. A drive shaft is coupled to a first one-way clutch in one direction and an idler cam shaft is coupled to a second one-way clutch in the opposite direction. This allows the idler cam shaft to be driven only when the motor is reversed, and the drive shaft to be driven only when the motor is moving forward. The one-way clutch on the drive shaft allows the drive wheels to freewheel when the motor is reversed in order to engage the nip release. Thus, the nip release is activated while the drive nip continues to rotate in the direction of sheet motion.

20 Claims, 3 Drawing Sheets

DRIVE ROLL/IDLER ROLL NIP RELEASE MECHANISM

This disclosure relates to paper handling systems for xerographic marking and devices, and more specifically, relates to an improved drive roll/idler roll nip release mechanism used in media or sheet registration.

Heretofore, media path drive roller nips have been opened in order to disengage by using an electrical solenoid or dedicated motor in order to activate the nip release (idlers lifted) mechanism upstream of a registration nip. One actuator is required to drive the nip release mechanism. An improvement to this type of nip release mechanism is shown in U.S. Pat. No. 7,506,870 B2 where one or more cams are operatively connected to corresponding ones of idler rolls within nip drive assemblies. As the cams rotate, the cams move the idler rolls between a first position biased against the driver rolls and a second position out of contact with the drive rolls. A camshaft is operatively connected to the cams, and the camshaft is operatively connected to a clutch driven by the drive motor/axle of the nip drive assembly. The camshaft is rotated by the clutch only when the drive axle rotates in a reverse direction opposite the forward direction. Thus, the forward movement of the drive axle moves media through the drive nips and reverse movement of the drive axle rotates the cams, thereby controlling the position of the idler rolls. A limitation of this nip release mechanism is the fact that the drive nips must be driven in reverse in order to initiate the separation of idlers. If a sheet were present in the drive nip as the nip release is initiated, it would momentarily be stopped and then driven in reverse until the idlers were sufficiently lifted. This makes the described mechanism impractical for certain applications, such as the release of an upstream nip in order to allow a downstream nip to assume full control of a sheet.

Accordingly, disclosed herein is a drive roll/idler roll nip release mechanism that utilizes the motor used for the drive nip, coupled with one-way clutches, to power the nip release as a sheet is handed off to a downstream nip. A drive shaft is coupled to a one-way clutch in one direction, whereas the idler cam shaft is coupled to a one-way clutch in the opposite direction. This allows the idler cam shaft to be driven only when the motor is reversed, and the drive shaft to be driven only when the motor is moving forward. The one-way clutch on the drive shaft allows the drive wheels to freewheel when the motor is reversed in order to engage the nip release. This configuration allows the nip release mechanism to be activated while the sheet is still under the drive nip, as long as the lead edge of the sheet has been acquired by a downstream nip, and thus increases sheet throughput through the nip.

Various of the above-mentioned and further features and advantages will be apparent to those skilled in the art from the specific apparatus and its operation or methods described in the example(s) below, and the claims. Thus, they will be better understood from this description of these specific embodiment(s), including the drawing figures (which are approximately to scale) wherein:

Figure 1:
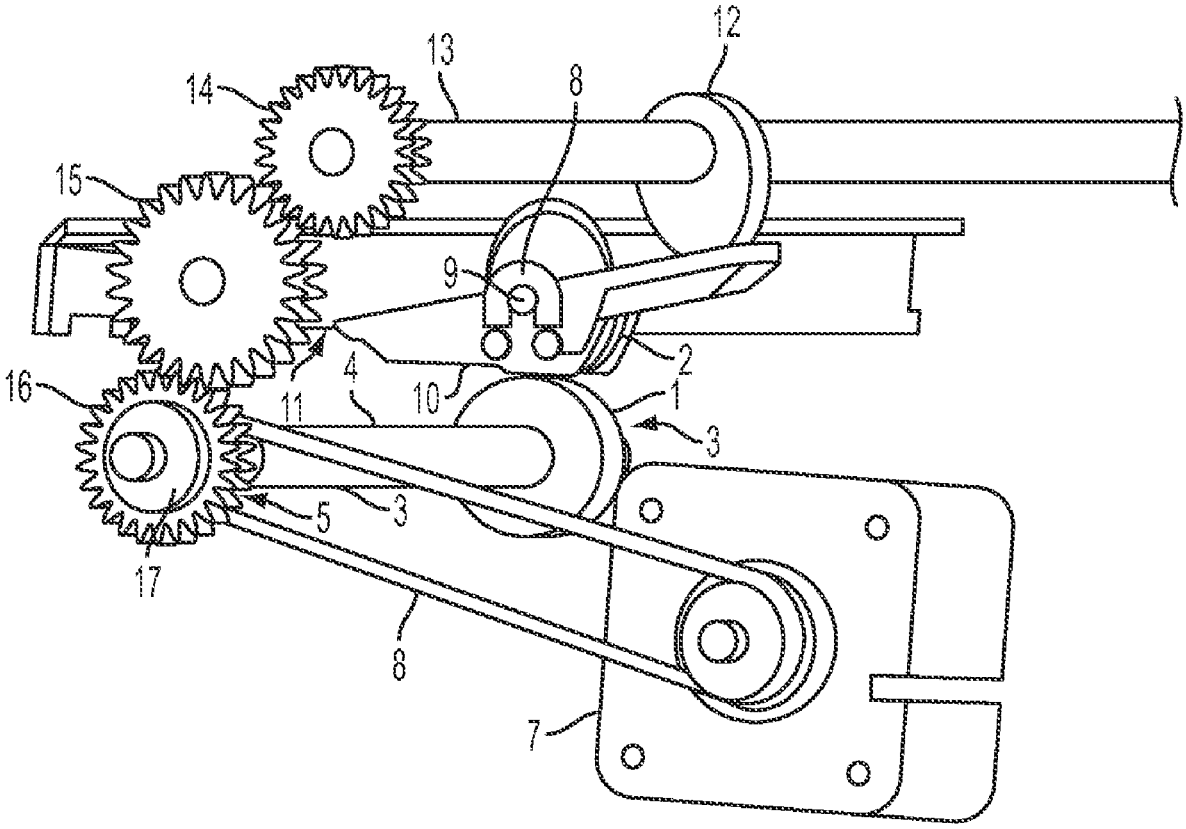
FIG. 1 PRIOR ART
FIGS. 1 and 2 are a partial perspective views of a prior art nip release mechanism.

In prior art FIG. 1, a media drive nip is formed by a drive roll 1 and an idler roll 2. The drive roll 1 is driven as part of the drive roll assembly 3, which also includes a shaft or drive axle

4 and a drive pulley 5. This drive roll assembly 3 is driven by a timing belt 6, which in turn is driven by a motor assembly 7 with attached pulley. Alternatively, the drive roll assembly 3 could be driven by a gear train or could be directly attached to the driver motor.

When the nip is in the engaged (loaded) state (FIG. 1), the idler roll 2 is biased against the drive roll 1 by load springs 8. The load springs bear against the idler shaft 9, which in turn bears against the idler roll 2. The load springs 8 attach to the idler sled or movable support 10. The idler shaft 9 is constrained by a slot in the idler sled 10, but the slot does not prevent the load springs 8 from applying the proper nip load to the idler roll 2. The idler sled 10 is held in place on one end by the idler sled pivot 11, which is fixed. The idler sled is held down on the other end by the nip load cam 12. Cam 12 is rotated down to the loaded position.

Figure 2:
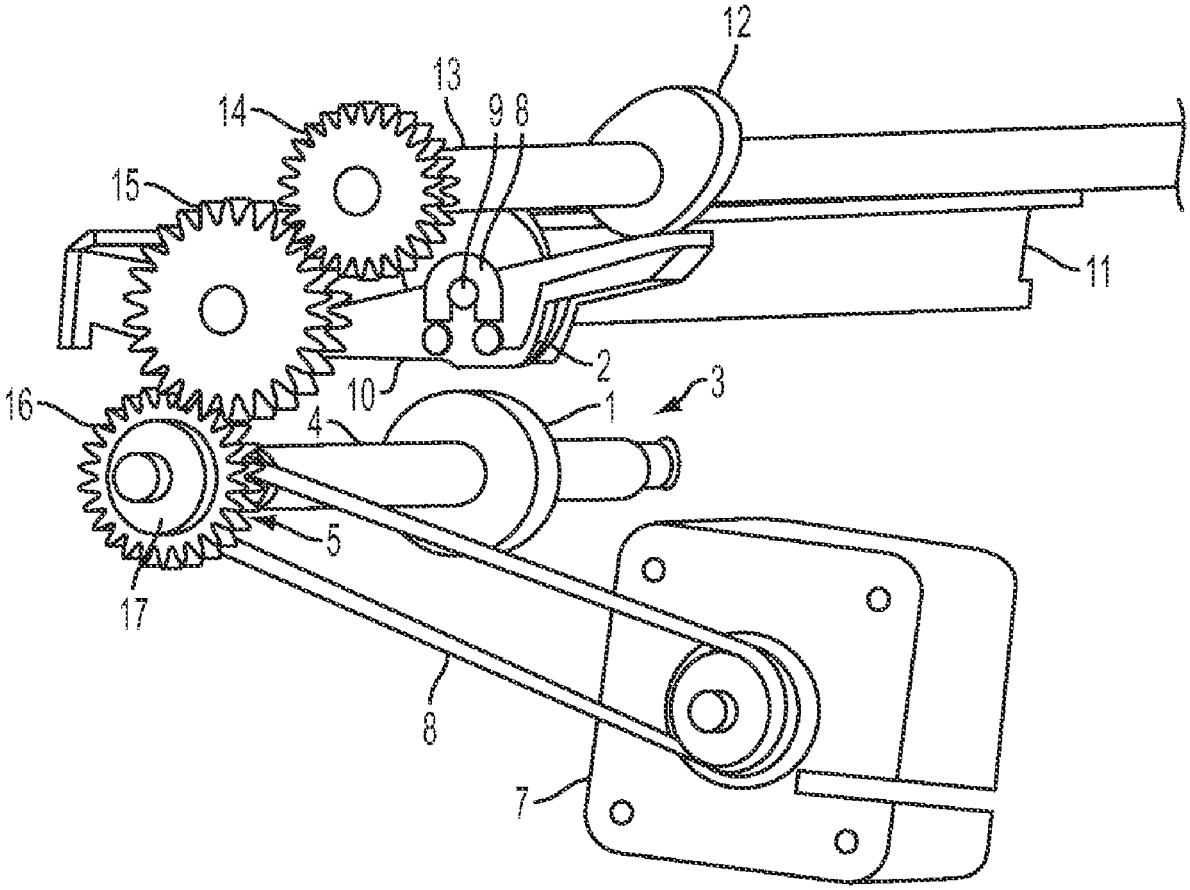
FIG. 2 PRIOR ART

When the nip is in the released (unloaded) state (FIG. 2), the idler roll 2 is suspended above the drive roll 1 by the idler sled 10. The idler shaft 9 rests in the bottom of the slot in the idler sled 10. The idler sled 10 is pulled up against the nip load cam 12 by a return spring (not shown). Cam 12 is rotated up to the unloaded position.

The nip load cam 12 is rotated on the nip load camshaft 13, which is driven by gears 14-16. Gear 16 is fastened to the single direction device 17. By including clutch 17 within the gear 16 that is adjacent the drive axle 4, the gears 14-16 only rotate when the drive axle rotates in the reverse direction, which reduces wear of the gears 14-16. The roller clutch 17 is oriented such that forward rotation of the driver roll 1 does not act on gear 16, but rather acts as a roller bearing. Reverse rotation of the driver roll will lock the roll clutch such that the gear 16 is driven in order to select a different cam 12 position.

The clutch 17 is a one-way clutch that can, for example, include internal ratchets that engage in only one direction. The clutch 17 connects the gear 16 to the drive axle 4. Therefore, gear 16 only rotates when the drive axle 4 rotates in the reverse direction because when the drive axle 4 rotates in the forward direction, the clutch 17 spins freely and does not cause the gear 16 to rotate. Because of this, gear 16 will only rotate in the reverse direction and will only rotate when the drive axle 4 rotates in the reverse direction. Thus, one clutch is used to power the idler shaft while the drive shaft is driven in the opposite direction. In one application, this is used to change from wide to narrow stance and vice versa, that is, the cam settings determine which set of rolls are engaged for different sizes of media. This configuration enables the use of a one-way clutch to select the nip to be released for a given media size.

Figure 3:
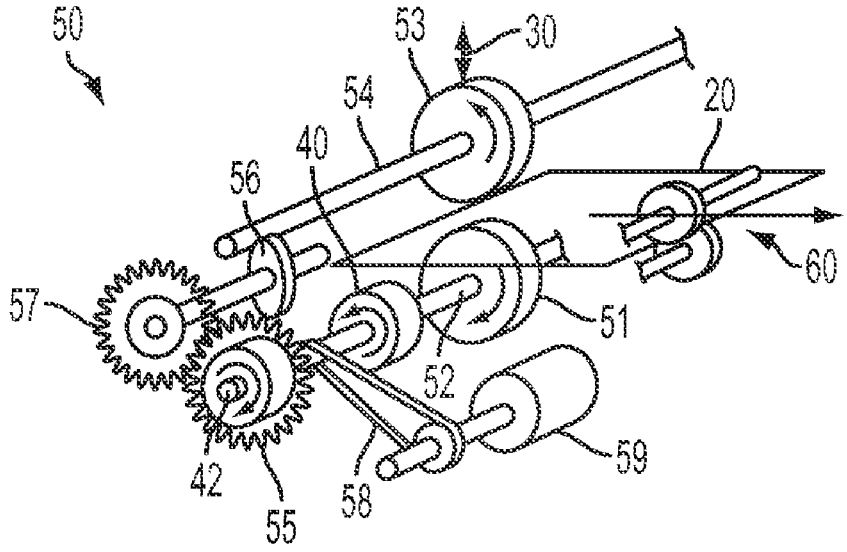
FIG. 3 is a partial perspective view of nip a release mechanism in accordance with one embodiment of the present disclosure.

An improvement to the heretofore described nip release mechanism in accordance with the present disclosure is shown in FIG. 3 where a single motor is used for the drive nip, coupled with two one-way clutches, to power the nip release as the sheet 20 is handed off to downstream nip 60. In the nip release mechanism 50, a media or sheet drive nip is formed by a drive roll 51 and an idler roll 53 that conveys sheets into a registration nip 60 which in turn conveys the now registered sheets downstream to receive images thereon. The drive roll 51 is mounted on shaft or drive axle 52 that is connected to gear 55. The drive roll 51 is driven by timing belt 58, which in turn is driven by motor 59 with an attached pulley. Idler roll 53 is mounted on a shaft or axle 54 and adapted to be moved in the directions of arrow 30 by cam 56 which is rotated by gear 57 when gear 55 is rotated by motor 59 in a counter-clockwise direction. Two in-line, one-way slip clutches 40 and 42 are mounted on drive axle 52 and are critical to the function of the nip release mechanism 50. The one-way clutches slip in the direction of the arrows on the clutches. Drive axle 52 is coupled through one-way clutch 40 to rotate drive roll 51 in a clockwise direction upon actuation of motor 59, while idler cam axle driving cam 56 is coupled to one-way clutch 42 in the opposite or counter-clockwise direction through gear 57. This allows cam axle 54 to be driven only when motor 59 is reversed, and the drive axle 52 to be driven only when the motor 59 is moving forward. One-way clutch 40 on the drive axle 52 allows drive roll 51 to freewheel or rotate freely when the motor is reversed in order to engage the nip release. Reversing of motor 59 causes one-way clutch 42 to engage and through gears 55 and 57 rotate cam 56 to lift or release idler roll 53 away from driver roll 51. This configuration allows the nip release to be activated while the sheet is still under the drive of roll 51, so long as the lead edge of the sheet has been acquired by the downstream nip 60.

Figure 4:
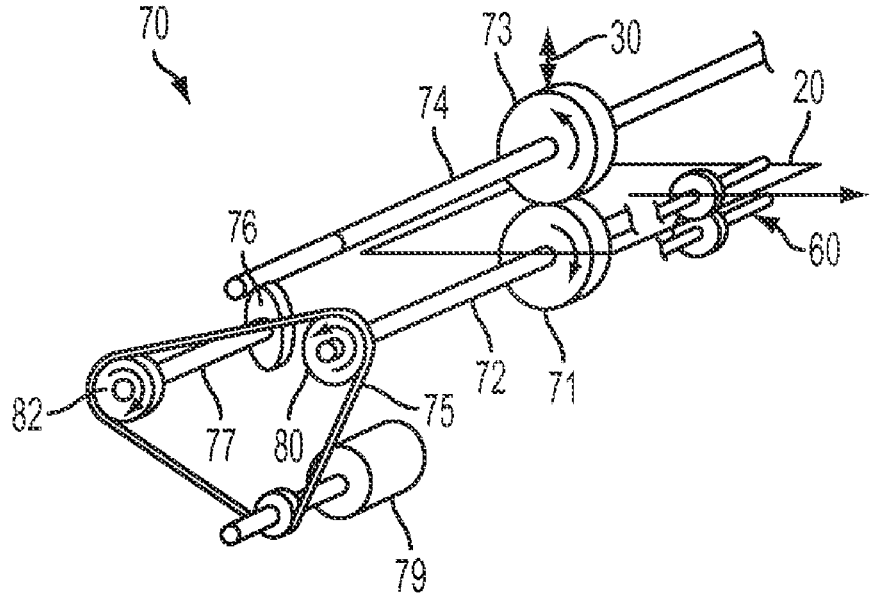
FIG. 4 is a partial perspective view of a nip release mechanism in accordance with another embodiment of the present disclosure.

An alternative nip release mechanism 70 is shown in FIG. 4 that includes a sheet drive nip formed by a drive roll 71 and an idler roll 73 that conveys sheets into a registration nip 60 which in turn conveys the now registered sheets downstream for xerographic marking. The drive roll 71 is mounted on shaft or drive axle 72 that is connected to a one-way slip clutch 80. Drive roll 71 is driven by timing belt 75, which in turn is driven by motor 79. Idler roll 73 is mounted on a shaft or axle 74 and adapted to be moved in the directions of arrow 30 by cam 76 that is mounted on axle 77. Two one-way slip clutches 80 and 82 are mounted (to slip in the direction of the arrows) on drive axle 72 and cam axle 77, respectively, and are essential to nip release mechanism 70 functioning as required. Drive axle 72 is coupled through one-way clutch 80 to rotate drive roll 71 in a clockwise direction upon actuation of motor 79 which in turn rotates idler roll 73 in a counter-clockwise direction when a nip is formed therebetween. One-way clutch 80 on the drive axle 72 allows drive roll 71 to rotate freely when the motor is reversed in order to engage the nip release. Reversing of motor 79 causes one-way clutch 82 to engage and through axle 77 rotate cam 76 to lift or release idler roll 73 from drive roll 71. The nip is released once the lead edge of sheet 20 is in the registration nip 60. Reversing the motor velocity at the appropriate time will enable this. Since the sheet is being driven by the registration nip 60, the upstream drive roll will rotate in the direction of sheet travel as long as there is contact with the idler even if the motor velocity is decreased or changes direction. A cost savings is realized with this embodiment since there is no need to provide a separate electromechanical actuator for the nip release function. Instead, inexpensive mechanical components are used.

In recapitulation, it should now be understood that an improved nip release mechanism in a paper handling device of a printer has been disclosed that utilizes the motor used for a drive nip, coupled with one-way-clutches, to power release of the nip as paper is handed off to a downstream registration nip. The drive shaft is coupled to a one-way clutch in one direction while an idler cam shaft is coupled to a one-way clutch in the opposite direction. This allows the idler cam shaft to be driven only when the motor is reversed, and the drive shaft to be driven only when the motor is moving forward. The one-way clutch on the drive shaft allows drive wheels to freewheel when the motor is reversed in order to engage the nip release. Thus, the nip release is activated while the sheet is still under the drive nip as long as the lead edge of the sheet has been acquired by the down stream nip. This nip release mechanism is useful in a printing apparatus, such as, electrostatographic and/or xerographic machines.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A printing apparatus, comprising:

at least one releasable media drive nip including a drive roll and an idler roll in mating engagement with said drive roll and adapted to drive media for capture by a downstream nip;

a drive member operatively connected to said drive roll, wherein said drive member is adapted to rotate in a forward direction when moving media through said media drive nip;

an idler mounting member operatively connected to said idler roll and supporting said idler roll such that rotation of said drive roll rotates said idler roll;

a cam operatively connected to said idler roll, wherein as said cam rotates, said cam moves said idler roll between a first position of mating engagement with said drive roll and a second position out of contact with said drive roll;

a drive motor operatively connected to said drive member, wherein said drive motor is adapted to drive said drive member in said forward direction when rotated in a first direction and said drive motor is adapted to drive said cam when rotated in a second direction; and at least two single direction devices supported by said drive member and operatively connected to said drive motor, wherein one of said at least two single direction devices is operative only when said drive motor is rotated in a first direction and the other of said at least two single direction devices is operative only when said drive motor is rotated in a second direction in order to allow said media drive nip to be activated for release while said media is under said media drive nip and a lead edge thereof has been simultaneously acquired by said downstream nip.

2. The apparatus of claim 1, including a first gear operatively connected to said drive member.

3. The apparatus of claim 2, wherein said at least two single direction devices are positioned on opposite sides of said first gear on said drive member.

4. The apparatus of claim 3, including a camshaft operatively connected to said cam, wherein said camshaft is operatively connected to said other of said at least two single direction devices.

5. The apparatus of claim 4, including a second gear, and wherein said second gear is operatively connected to said first gear and said camshaft such that rotation of said first gear rotates said camshaft and said cam.

6. The apparatus of claim 1, wherein said at least two single direction devices comprise one-way clutches.

7. The apparatus of claim 1, wherein one of said single direction clutches engages said cam operatively connected to said idler roll when said motor is driven in a reverse direction, and the second of said single direction clutches allows said media drive nip to continue rotating in a forward direction when said motor is driven in said reverse direction.

8. The apparatus of claim 4, including a timing belt operatively connecting said drive motor to said first gear.

9. A nip release mechanism, comprising:

at least one media drive nip including a drive roll and an idler roll in mating engagement with said drive roll;

a drive member operatively connected to said drive roll, wherein said drive member is adapted to rotate in a forward direction when moving media through said media drive nip;

an idler mounting member operatively connected to said idler roll and supporting said idler roll such that rotation of said drive roll rotates said idler roll;

a cam member mounted on a camshaft and operatively connected to said idler roll, wherein as said cam rotates, said cam moves said idler roll between a first position of mating engagement with said drive roll and a second position out of contact with said drive roll;

a single drive motor operatively connected to said drive member and said idler member, wherein said drive motor is adapted to drive said drive member in said forward direction when rotated in a first direction and drive said cam when rotated in a second direction;

at least two single direction devices, wherein one of said at least two single direction devices is operative only when said drive motor is rotated in a first direction and the other of said at least two single direction devices is operative only when said drive motor is rotated in a second direction in order to allow said nip release mechanism to be activated while media is under said media drive nip and simultaneously captured by a downstream nip.

10. The nip release mechanism of claim 9, wherein one of said at least two single direction devices is mounted on an end portion of said drive member.

11. The nip release mechanism of claim 10, wherein said other of said at least two single direction devices is mounted on an end portion of said camshaft.

12. The nip release mechanism of claim 11, wherein said camshaft is operatively connected to said cam, and wherein said camshaft is operatively connected to said other of said at least two single direction devices, and wherein said other of said at least two single direction devices is operative only when said drive member rotates in a reverse direction.

13. The apparatus of claim 12, wherein one of said single direction devices engages said cam operatively connected to said idler roll when said motor is driven in a reverse direction, and said other of said single direction devices allows said media drive nip to continue rotating in a forward direction when said motor is driven in said reverse direction.

14. The nip release mechanism of claim 9, including at least one nip downstream of said at least one media drive nip, and wherein said media drive nip is released once a lead edge of said media is within said at least one downstream nip without backward movement of said media.

15. A method for releasing a nip formed between a feed roll and an idler roll, comprising:

providing at least one media drive nip including a drive roll and an idler roll in mating engagement with said drive roll and positioned upstream of a second media drive nip;

providing a drive member operatively connected to said drive roll, wherein said drive member is adapted to rotate in a forward direction when moving media through said media drive nip;

providing an idler mounting member operatively connected to said idler roll and supporting said idler roll such that rotation of said drive roll rotates said idler roll;

providing a cam member mounted on a camshaft and operatively connected to said idler roll, wherein as said cam rotates, said cam moves said idler roll between a first position of mating engagement with said drive roll and a second position out of contact with said drive roll;

providing a drive motor operatively connected to said drive member, wherein said drive motor is adapted to drive said drive member in said forward direction when rotated in a first direction and is adapted to drive said cam when rotated in a second;

providing at least two single direction devices, wherein one of said at least two single direction devices is operative only when said drive motor is rotated in a first direction and the other of said at least two single direction devices is operative only when said drive motor is rotated in a second direction and releasing said nip while a sheet of media is simultaneously within said media drive nip and being driven by said second media drive nip.

16. The method of claim 15, including mounting one of said at least two single direction devices on an end portion of said drive member.

17. The method of claim 16, including mounting said other of said at least two single direction devices on an end portion of said camshaft.

18. The method of claim 17, providing said camshaft operatively connected to said cam, and wherein said camshaft is operatively connected to said other of said at least two single direction devices, and wherein said other of said at least two single direction devices is operative only when said drive member rotates in a reverse direction.

19. The method of claim 15, including providing said at least two single direction devices as one-way clutches with both being positioned on said drive member.

20. The method of claim 15, further providing releasing said media drive nip once a lead edge of said media is in said second media drive nip.

* * * * *